US008179744B2

(12) United States Patent
Laucella et al.

(10) Patent No.: US 8,179,744 B2
(45) Date of Patent: May 15, 2012

(54) DISPLAY DEVICE FOR DISPLAYING ONE OR OTHER OF TWO DIFFERENT INDICATIONS WITH THE SAME TIMEPIECE INDICATOR MEMBER

(75) Inventors: Vincent Laucella, Le Brassus (CH); Jean-Philippe Rochat, Les Bioux (CH)

(73) Assignee: Montres Breguet S.A., L'Abbaye (CH)

( * ) Notice: Subject to any disclaimer, the term of this patent is extended or adjusted under 35 U.S.C. 154(b) by 451 days.

(21) Appl. No.: 12/485,413

(22) Filed: Jun. 16, 2009

(65) Prior Publication Data

US 2009/0310445 A1 Dec. 17, 2009

(30) Foreign Application Priority Data

Jun. 17, 2008 (EP) ..... 08158405

(51) Int. Cl.
*G04F 8/00* (2006.01)

(52) U.S. Cl. ..... 368/110; 368/80

(58) Field of Classification Search ..... 368/80, 368/97, 101, 110, 223
See application file for complete search history.

(56) References Cited

U.S. PATENT DOCUMENTS 4,021,046 A * 5/1977 Barlow ..... 273/148 R
7,731,416 B2 * 6/2010 Mahler et al. ..... 368/190
8,004,936 B2 * 8/2011 Ruchonnet ..... 368/77
2005/0249044 A1 * 11/2005 Forsey et al. ..... 368/110
2008/0205200 A1 * 8/2008 Spode et al. ..... 368/172

FOREIGN PATENT DOCUMENTS

CH 693 155 A5 3/2003
WO 20071115984 A2 10/2007

OTHER PUBLICATIONS

European Search Report issued in corresponding application No. EP 08 15 8405, completed Feb. 6, 2009.

* cited by examiner

*Primary Examiner* — Renee Luebke
*Assistant Examiner* — Jason Collins
(74) *Attorney, Agent, or Firm* — Griffin & Szipl, P.C.

(57) ABSTRACT

The timepiece display device includes a rotating analogue indicator member (21), a first counter wheel set (38) and a second counter wheel set (44), whose positions are respectively representative of two magnitudes to be displayed by said indicator member (21), and a switch mechanism (40) with manual control (23) for selectively displaying the first or second magnitude via the indicator member. The display device is characterized in that the switch mechanism includes a rotating arbour (73) kinematically connected to the indicator member (21) and a sliding wheel set (71) secured to the arbour in rotation and provided for sliding, via the action of the manual control device (23), so as to selectively occupy on the arbour (73) a first axial position, in which the sliding wheel set (71) is coupled with the first counter wheel set (38), and a second axial position, in which the sliding wheel set (71) is coupled with the second counter wheel set (44).

16 Claims, 5 Drawing Sheets

DISPLAY DEVICE FOR DISPLAYING ONE OR OTHER OF TWO DIFFERENT INDICATIONS WITH THE SAME TIMEPIECE INDICATOR MEMBER

This application claims priority from European Patent Application No. 08158405.4, filed Jun. 17, 2008, the entire disclosure of which is incorporated herein by reference.

FIELD OF THE INVENTION

The present invention generally concerns a timepiece display device that includes a rotating analogue indicator member, a first counter wheel set and a second counter wheel set, whose angular positions respectively represent a first magnitude and a second magnitude to be displayed by the indicator member, and a manually controlled switch mechanism for selectively displaying the first or second magnitude via the display device. The present invention also concerns a timepiece that includes a display device of the aforementioned type.

BACKGROUND OF THE INVENTION

Timepiece display devices that match the above definition are already known. CH Patent No. 693,155 discloses a switch mechanism that includes two heart-pieces carried by two wheel sets whose angular positions are respectively representative of two variable magnitudes. The first wheel set and the heart-piece that it carries are driven in rotation by the timepiece movement. Moreover, in a similar manner to a device that is known in split-seconds chronographs, a wheel carrying a hand is freely mounted on the rotational arbour of the first wheel set. This wheel carries a lever, which is permanently returned against the flank of the heart-piece by a small spring.

With this mechanism of the prior art, the hand indicates the variable magnitude represented by the angular position of the second wheel set. If the person wearing the timepiece wishes to switch the display to see the first variable magnitude, he activates a switch mechanism that acts, first of all, by uncoupling the hand from the second heart-piece. Once uncoupling is carried out, the hand is then only connected to the wheel that carries the lever returned against the flank of the first heart-piece. In this case, the weak pressure exerted by the lever is enough to cause it to slide against the heart-piece flank, and thus to rotate the lever about the heart-piece with the wheel that carries it. At the end of its travel around the heart-piece, the inclined portion of the lever is locked against the base of the heart-piece, and the heart-piece is thus coupled with the hand. It will be clear that the effect of the action of the lever on the heart-piece is to bring and then keep the hand in the position that represents the state of the first variable magnitude.

According to this prior art document, switching the display in the opposite direction is considerably more complex. Indeed, for the display to pass from the first to the second variable magnitude involves a differential gear including a planetary wheel holder, which is secured to the second heart-piece of the mechanism.

SUMMARY OF THE INVENTION

It is thus an object of the present invention to provide a timepiece display device that includes a switch mechanism for selectively displaying a first or second magnitude via the same indicator member, the mechanism being simpler and more compact than those that have been proposed up to now.

The present invention achieves this object by providing a display device in accordance with claim 1.

It is important to specify that the expression "first (or second) counter wheel set" in the claims does not simply designate a chronograph counter. On the contrary, this expression generally designates any wheel set whose angular position represents a magnitude that can be displayed by a rotating analogue indicator member.

BRIEF DESCRIPTION OF THE DRAWINGS

Other features and advantages of the present invention will appear upon reading the following description, given solely by way of non-limiting example, with reference to the annexed drawings, in which.

DETAILED DESCRIPTION OF THE ILLUSTRATIVE EMBODIMENTS

Figure 1:
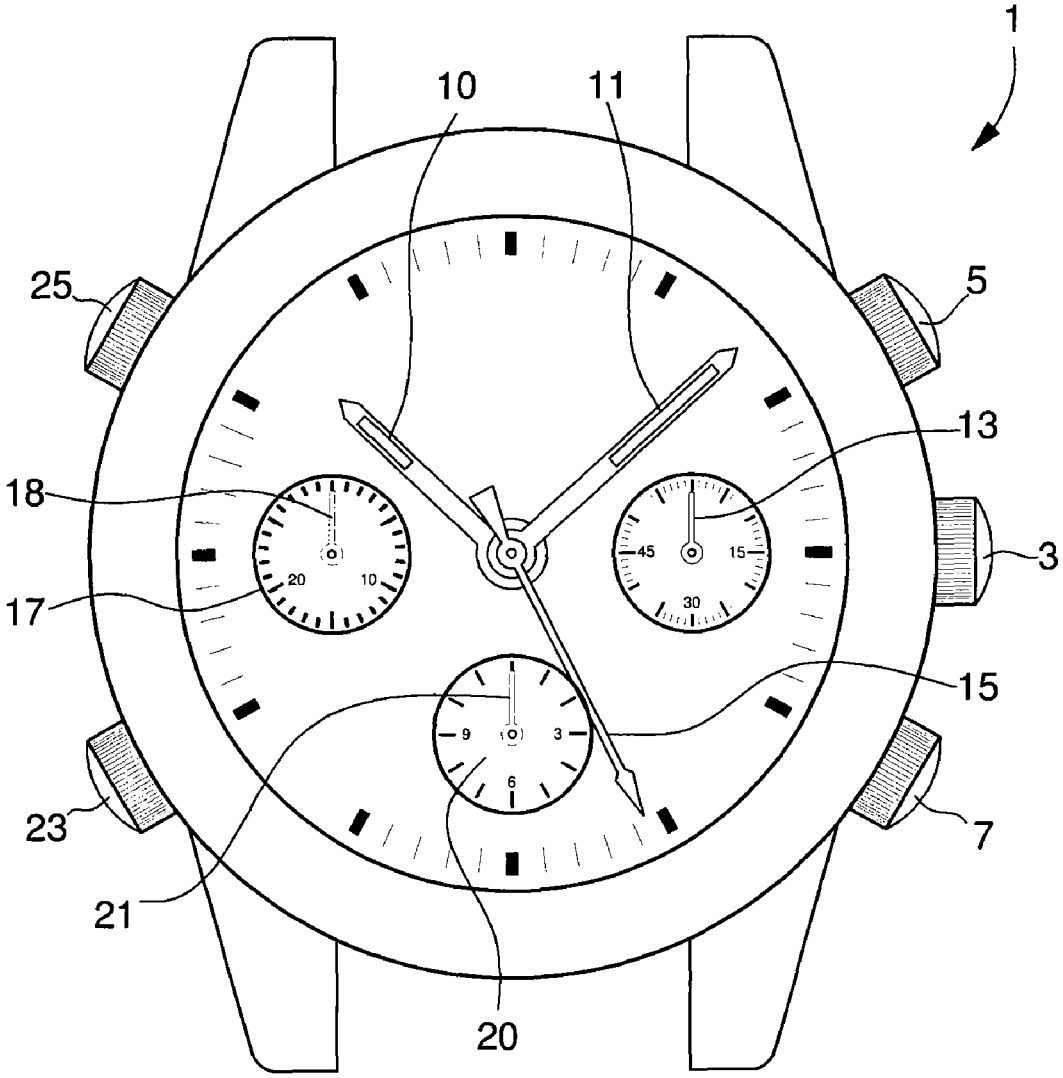
FIG. 1 is a top view of a wristwatch with a chronograph including a display mechanism that corresponds to a particular embodiment of the present invention.

As illustrated by FIG. 1, the display device according to the present invention may, according to a variant, be integrated in a chronograph watch 1. In the following description, the terms "3 o'clock, 6 o'clock, 9 o'clock, 12 o'clock, high, low, top" and "bottom" are used with reference to a chronograph watch seen from above, i.e. seen from the dial side as shown in FIG. 1.

Chronograph watch 1 can display the current time using an hour hand 10, a minute hand 11 and a small seconds hand 13 arranged at 3 o'clock. In a conventional manner, it also includes a winding and time-setting stem 3. To ensure the chronograph function, the watch also includes a chronograph mechanism that can be switched on manually and is for measuring the time that has elapsed since it was switched on. For this purpose watch 1 includes, in a conventional manner, a first push button 5 that is placed at 2 o'clock and controls the chronograph start and stop functions, and a second push button 7 that is placed at 4 o'clock and controls the chronograph reset function. The watch is for displaying the time elapsed by means of a central trotteuse 15 indicating the seconds, a thirty minute counter 17 that is placed at 9 o'clock and includes a hand 18 and, finally, a twelve hour counter 20 that is placed at 6 o'clock and has a hand 21.

According to the invention, the chronograph watch of FIG. 1 further includes a manually controlled switch mechanism for selectively displaying, via the same indicator member, either a first magnitude or a second magnitude. In the present example, the first magnitude is the elapsed time measured by the chronograph mechanism, and the second magnitude is the current time in a second time zone. It is hand 21 of time counter 20 that forms the indicator member for displaying the first and second magnitudes. FIG. 1 shows that watch 1 includes two additional push buttons 23, 25. In the present example, the first of these additional push buttons 23, placed at 8 o'clock, fulfils the manual control function for the switch mechanism according to the invention. The function of the second additional push button 25, placed at 10 o'clock, will be explained below.

Figure 2:
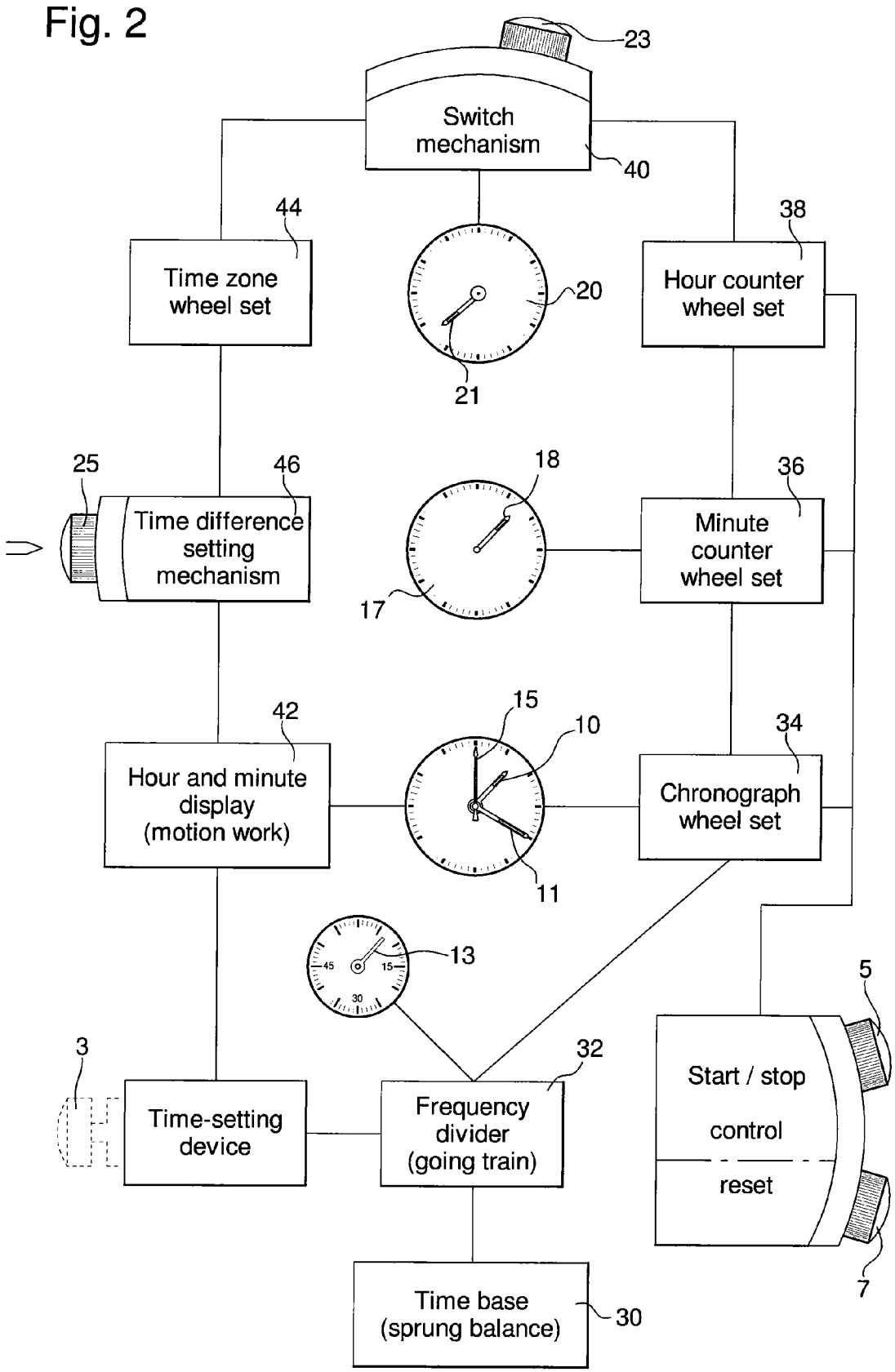
FIG. 2 is a flow chart that describes the operation of the chronograph watch of FIG. 1.

Referring now to the flow chart of FIG. 2, it can be seen that chronograph watch 1 includes, in a conventional manner, a time base 30 associated with a frequency divider 32 for controlling the working of a current time display. Hands 10, 11 and 13 for the current time display are also schematically shown in FIG. 2. Time base 30 can also obviously be made in the form of a sprung balance, and the going train driving the balance can form the frequency divider 32. The chronograph watch shown is also fitted with a conventional time-setting device for cooperating with a motion work 42 so as to change the hour 10 and minute 11 display. The winding and time-setting stem 3 that controls the time-setting mechanism is also shown schematically in FIG. 2.

FIG. 2 also shows a chronograph wheel set 34, which carries trotteuse 15, a minute counter wheel set 36 that carries the hand 18 of minute counter 17, and an hour counter wheel set 38 for driving the hand 21 of hour counter 20 via the switch mechanism 40 according to the invention. This switch mechanism, the operation of which will be described in more detail below, is activated manually using push button 23. With the exception of switch mechanism 40, the elements that have just been described are standard chronograph mechanism components. FIG. 2 also shows schematically the first push button 5, for starting and stopping the chronograph mechanism, and the second push button 7 for resetting the chronograph mechanism.

Finally, FIG. 2 also shows a "time zone" hour wheel set 44, which is alternately coupled to/uncoupled from hand 21 of hour counter 20 by switch mechanism 40. The hour wheel set 44 is itself driven by motion work 42 via a time difference setting mechanism 4 controlled by push button 25.

A particular embodiment of the display device according to the present invention will now be described with reference to FIGS. 3, 4, 5 and 6. As already stated, in this embodiment, it is the chronograph hour counter that can display alternatively one or other of two indications. In other words, in the present example, it is the hour counter hand 21 that forms the display device indicator member of the present invention.

Figure 6:
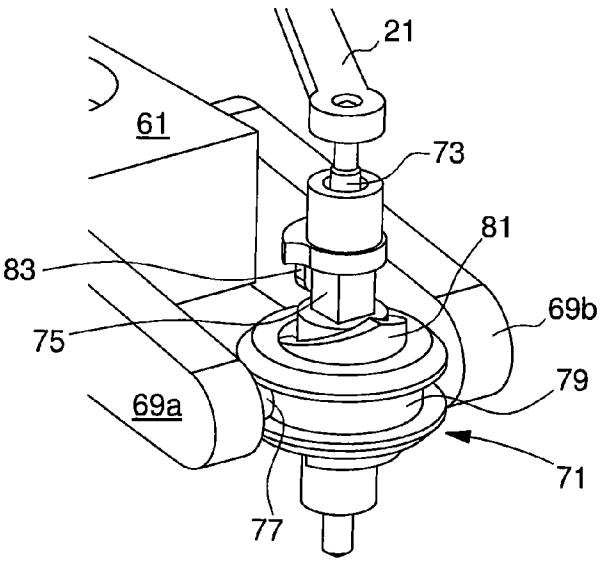
FIG. 6 is a partial view of the display device of FIGS. 3, 4 and 5, wherein the first and second counter wheel sets have been omitted to show the phase synchronisation and lock means as well as other elements that form part of a particular embodiment of the switch mechanism according to the invention.

FIG. 6 shows in detail one embodiment of the rotating arbour 73 and the sliding wheel set, or selector 71, which are at the centre of the switch mechanism of the invention. As can be seen in the example illustrated, rotating arbour 73 of the switch mechanism is an arbour that is oriented vertically (perpendicular to the plane of the watch) at one end of which the hour counter hand 21 is directly mounted. At the other end, rotating arbour 71 has a long square 75 on which selector 71, whose hole is also square, has the possibility of sliding between a first and second axial end position. The cooperation of these two squares, that of the rotating arbour and that of the selector, ensures that these two elements are secured to each other in rotation.

Figure 4:
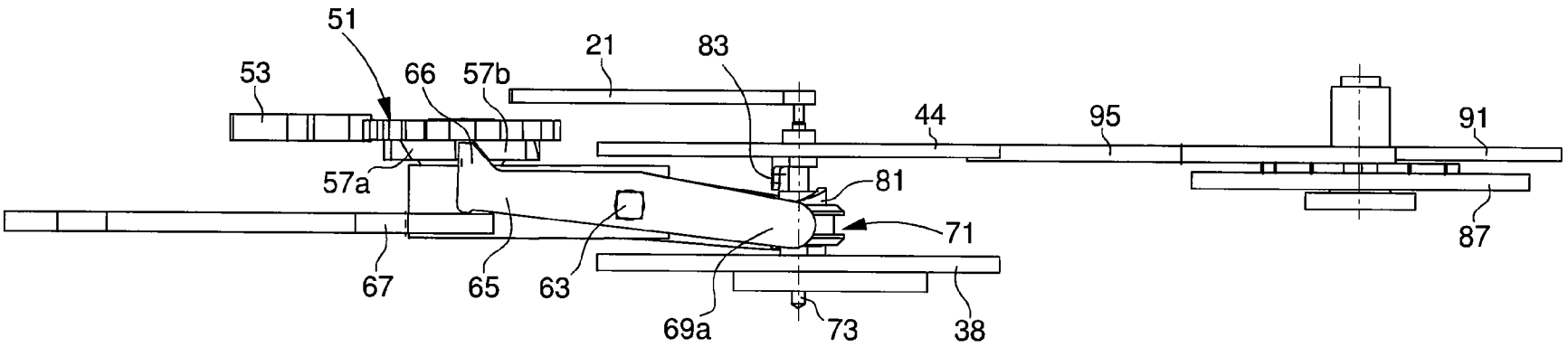
FIG. 4 is a cross-section of the display device of FIG. 3.
Figure 5:
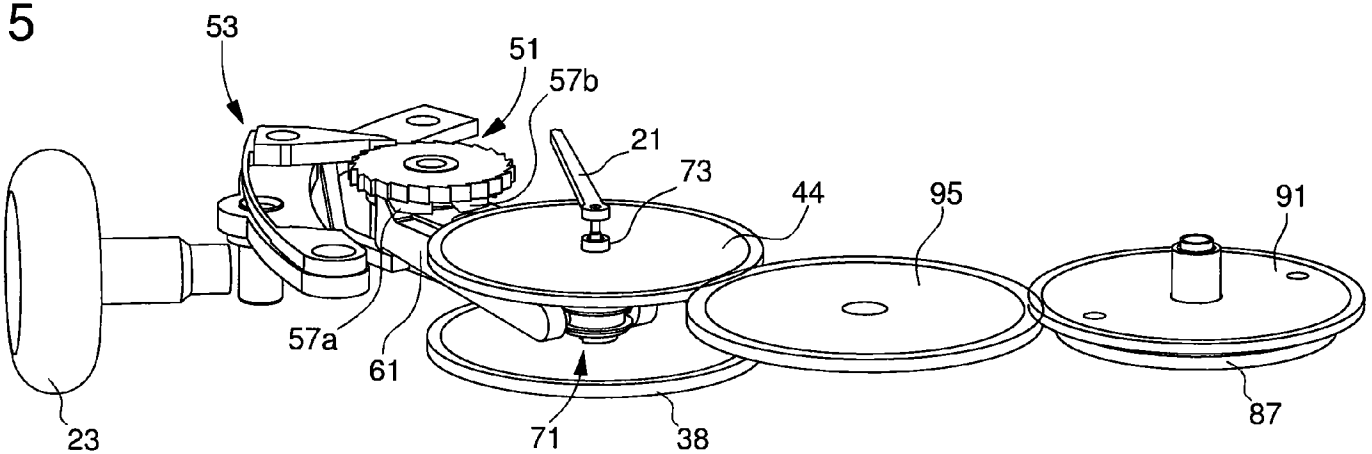
FIG. 5 is a perspective view of the display device of FIGS. 3 and 4.

FIGS. 4, 5 and 6 show selector 71 in the first axial position, i.e. in the bottom position, pressed against the wheel, or wheel set, of hour counter 38. In this position, the selector is coupled to the hour counter wheel, which can then drive the selector in rotation. It will be clear that in the first axial position, the hour counter hand 21 is connected to the hour counter wheel 38 so as to indicate the elapsed hours measured by the chronograph mechanism.

It will be clear that, when selector 71 is in the second axial position, i.e. in the top position (not shown), it is pressed against the "time zone" hour wheel or wheel set 44. In the second axial position, the selector is thus coupled to the "time zone" hour wheel.

The switch mechanism of the invention also includes first and second phase synchronisation and lock means for synchronising the rotating arbour with the wheel set that drives it. Only the second phase synchronisation and lock means, which are for adjusting the angular position of arbour 73 to that of the hour wheel 44, are visible in FIG. 6. These synchronisation means include a bell-shaped cam 81 formed in the top surface of selector 71 and a cam follower, or index 83, secured to "time zone" hour wheel 44. When selector 71 is pressed against hour wheel 44, index 82 abuts against the inclined surface of cam 81, which has the effect of rotating said cam while driving selector 71 and rotating arbour 73. Index 83 rotates cam 81 by sliding over the inclined surface thereof until it is at the bottom, at the lowest place, called the notch of the cam. Once index 83 is wedged in the bell of the cam, "time zone" hour wheel 44 and selector 71 are synchronised.

Although the Figures do not clearly show the first phase synchronisation and lock means for adjusting the angular position of arbour 73 to that of hour counter wheel 38, it will be clear that they are entirely similar to the second means that have just been described. They include a bell-shaped cam, which is formed in the bottom surface of selector 71, and a cam follower, which is secured to hour counter wheel 38. When selector 71 is pressed against hour counter wheel 38, the cam follower abuts against the inclined surface of the cam, which has the effect of rotating said cam until selector 71 is synchronised with hour counter wheel 38.

The switch mechanism that has just been described is actuated by a column wheel. This column wheel 51 includes a peripheral, drive, saw toothing on which a manoeuvre lever 53 acts, pushed by a push button 23. In a conventional manner, column wheel 51 is held in a determined position by a jumper spring (not shown). The bottom surface of the column wheel also includes a series of columns 57*a*, 57*b* formed by contrate teeth separated from each other by recesses. FIG. 4 shows that the bottom of the recesses is flat and that the contrate teeth are truncated so that they also have a flattened end. The contrate toothing 57 includes half as many columns (or teeth) as the peripheral toothing, such that driving the toothing through one step by activating the push button brings the bottom of one recess and the flattened end of one tooth in succession opposite a given reference position.

A fork-shaped lever 61 forms the switch control device. Lever 61 is held by a horizontal arbour 63 about which it is free to pivot in a vertical plane. One end of the first arm 65 of the lever (corresponding to the handle of the fork) has a beak 66 that is returned against contrate toothing 57 by a return spring 67. The second arm of the lever is shaped to communicate its movement to selector 71. Thus, the second arm ends in a fork, between whose branches 69*a*, 69*b*, the selector is held. More specifically, as FIG. 6 shows, two coaxial cylindrical studs are respectively formed on the bottom surfaces of the two parallel branches 69*a*, 69*b* of the fork (only one of these studs referenced 77 is visible in FIG. 6). The two studs are for engaging in annular notch 79 of selector 71, so as to drive the latter so that it slides between the first and second axial positions.

Figure 3:
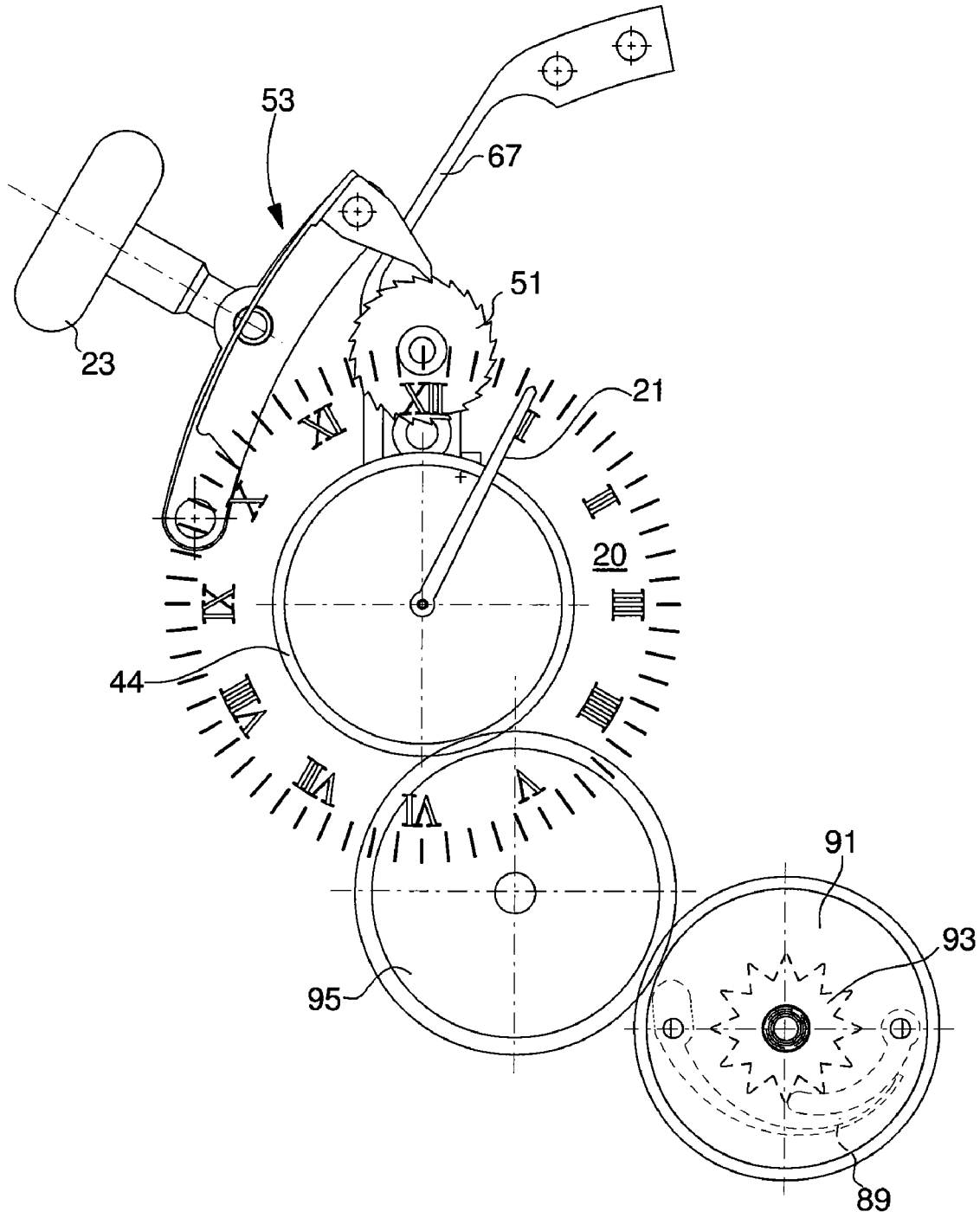
FIG. 3 is a top view of the display device according to the invention integrated in the chronograph watch of FIGS. 1 and 2 (some elements of the device that are placed under the chronograph watch dial are visible through the dial)

FIGS. 3, 4 and 5 also show the kinematic chain, which allows hour wheel 87 carrying hour hand 10 to drive the "time zone" hour wheel 44 as well. This kinematic chain includes a time zone wheel set, formed of a toothed wheel 91 and a star wheel with twelve branches 93, which is freely mounted on the pipe of the hour hand. As the Figures show, toothed wheel 91 and the hour wheel are coaxial and the star wheel 93 is mounted so as to rotate opposite hour wheel 87. The plate of the hour wheel carries a jumper spring 89, which is returned against star wheel 93 so as to hold the latter in a determined angular position relative to hour wheel 87. Since star wheel 93 has twelve branches, jumper spring 89 can immobilise it in twelve different positions corresponding to the 12 possible values of the time difference between two time zones.

Owing to the presence of jumper spring 89, the time zone wheel set and its toothed wheel 91 are driven by hour wheel 87 at the speed of one revolution per 12 hours. Moreover, toothed wheel 91 is arranged to drive the "time zone" hour wheel 44 via an intermediate wheel 95. Since wheel 44 and wheel 91 have the same number of teeth, they rotate at the same speed corresponding to one revolution in 12 hours. Further the time difference between hour hand 10 and the "time zone" hour wheel 44 is determined via cooperation between jumper spring 89 and the 12 branch star wheel 93. It is possible to set the time difference using push button 25 (FIGS. 1 and 2). The mechanism that changes the time difference by applying pressure to push button 25 will not be described here, since, on the one hand, it is not directly connected to the present invention and, on the other hand, this type of mechanism is known to those skilled in the art.

It will be clear that various alterations and/or improvements evident to those skilled in the art can be made to the embodiment that forms the subject of the present description, without departing from the scope of the present invention defined by the annexed claims. In particular, the rotating arbour does not need to be mounted vertically, and may very well rotate horizontally in the plane of the watch a little like a time-setting stem. In such conditions, if a lever controls the sliding wheel set, the lever may also move in the horizontal plane like a time-setting lever. It will also be clear that with this embodiment, the display member cannot be directly mounted on the rotating arbour, but must be driven via a gear train.

It will also be clear that the phase synchronisation and lock means of the invention do not necessarily include a bell-shaped cam. Indeed, instead of a cam, each of the phase synchronisation and lock means could for example include at least one magnet and a ferromagnetic element (or preferably at least two magnets), one being secured to the sliding wheel set and the other secured to the counter wheel set. In such a case, the phase lock would be ensured by the magnetic forces that appear between the magnet and the ferromagnetic element (or between the two magnets) when they move closer together. Moreover, according to yet another variant, the sliding wheel set could be formed by two heart-pieces and at least one differential gear as in CH Patent No 693,155. It will be clear, finally, that even if the phase synchronisation and lock means actually include a bell-shaped cam for cooperating with a cam follower, it could equally well be the sliding wheel set that carries the cam follower and the counter wheel set that carries the bell-shaped cam.

What is claimed is:

1. A timepiece display device including a rotating analogue indicator member, a first counter wheel set and a second counter wheel set, whose positions respectively represent a first magnitude and a second magnitude to be displayed by said indicator member, and a switch mechanism with manual control for selectively displaying the first or second magnitude via the indicator member, wherein the switch mechanism includes a rotating arbour kinematically connected to the indicator member and a sliding wheel set secured to the arbour in rotation and provided for sliding, via the action of the manual control device, so as to selectively occupy on the arbour a first axial position in which the sliding wheel set is coupled with the first counter wheel set, and a second axial position, in which the sliding wheel set is coupled with the second counter wheel set, and wherein the switch mechanism further includes first phase synchronisation means for adjusting the angular position of the rotating arbour to that of the first counter wheel set when the sliding wheel set occupies the first axial position, and second phase synchronisation means for adjusting the angular position of the rotating arbour to the position of the second counter wheel set when the sliding wheel set occupies the second axial position.

2. The display device according to claim 1, wherein at least one of the two magnitudes to be displayed by said indicator member is an elapsed time.

3. A chronograph watch wherein it includes a display mechanism according to claim 2.

4. The display device according to claim 1, wherein the first counter wheel set and the second counter wheel set are mounted freely on the rotating arbour on either side of the sliding wheel set.

5. The display device according to claim 4, wherein the rotating arbour is arranged vertically.

6. The display device according to claim 5, wherein said display member is secured to the rotating arbour.

7. A chronograph watch wherein it includes a display mechanism according to claim 6.

8. A chronograph watch wherein it includes a display mechanism according to claim 5.

9. A chronograph watch wherein it includes a display mechanism according to claim 4.

10. The display device according to claim 1, wherein said display member is driven by the rotating arbour via a gear train.

11. The chronograph watch wherein it includes a display mechanism according to claim 10.

12. The display device according to claim 1, wherein said first phase synchronisation means include a first bell-shaped cam and a first cam follower, which cooperate when the sliding wheel set occupies said first axial position, with either the first bell-shaped cam or the first cam follower being carried by said sliding wheel set and the other by said first counter wheel set.

13. The display device according to claim 12, wherein said second phase synchronisation means include a second bell-shaped cam and a second cam follower, which cooperate when the sliding wheel set occupies said second axial position, with either the second bell-shaped cam or the second cam follower being carried by said sliding wheel set and the other by said second counter wheel set.

14. A chronograph watch wherein it includes a display mechanism according to claim 13.

15. A chronograph watch wherein it includes a display mechanism according to claim 12.

16. A chronograph watch wherein it includes a display mechanism according to claim 1.

* * * * *